US011913661B2

(12) United States Patent
Yamaguchi

(10) Patent No.: US 11,913,661 B2
(45) Date of Patent: Feb. 27, 2024

(54) AIR-CONDITIONING SYSTEM

(71) Applicant: Mitsubishi Electric Corporation, Tokyo (JP)

(72) Inventor: Koji Yamaguchi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 595 days.

(21) Appl. No.: 17/256,797

(22) PCT Filed: Sep. 14, 2018

(86) PCT No.: PCT/JP2018/034199
§ 371 (c)(1),
(2) Date: Dec. 29, 2020

(87) PCT Pub. No.: WO2020/054055
PCT Pub. Date: Mar. 19, 2020

(65) Prior Publication Data

US 2021/0285676 A1 Sep. 16, 2021

(51) Int. Cl.
*F24F 11/56* (2018.01)
*F24F 11/52* (2018.01)
*F24F 11/54* (2018.01)

(52) U.S. Cl.
CPC ..... *F24F 11/56* (2018.01); *F24F 11/52* (2018.01); *F24F 11/54* (2018.01)

(58) Field of Classification Search
CPC .. F24F 11/56; F24F 11/52; F24F 11/54; F24F 1/0003
See application file for complete search history.

(56) References Cited

U.S. PATENT DOCUMENTS

2014/0324231 A1 10/2014 Kawai
2016/0084551 A1* 3/2016 Hur ..... F24F 11/62 62/160

(Continued)

FOREIGN PATENT DOCUMENTS

CN 1540256 A 10/2004
CN 103931208 A 7/2014

(Continued)

OTHER PUBLICATIONS

Office Action dated Mar. 1, 2022 issued in corresponding CN patent application No. 201880097053.6 (and English translation).

(Continued)

*Primary Examiner* — Brian Wilson
(74) *Attorney, Agent, or Firm* — POSZ LAW GROUP, PLC

(57) ABSTRACT

An air-conditioning system includes: an outdoor unit including an outdoor-side control device; indoor units each including an indoor-side control device controlling a device in response to an instruction; communication lines connecting the outdoor unit and the indoor units for communication between them; and a remote control unit including a remote-control controlling device and wirelessly communicating with each indoor unit. Each indoor unit includes an indoor-side setting device that determines an identification number identifying the indoor unit. When receiving, from the remote control unit, a signal including the instruction, the indoor-side control device determines whether or not to control the device based on an identification signal, and sends the signal to the outdoor unit via a communication line. The outdoor-side control device determines which indoor unit is an instruction target based on the identification signal and sends the signal to the instruction target indoor unit, via a communication line.

15 Claims, 6 Drawing Sheets

(56) References Cited

U.S. PATENT DOCUMENTS

| | | | | |
|---|---|---|---|---|
| 2016/0146492 | A1* | 5/2016 | Tomomatsu | F24F 11/61 700/276 |
| 2016/0265799 | A1 | 9/2016 | Matsuno et al. | |

FOREIGN PATENT DOCUMENTS

| | | | | |
|---|---|---|---|---|
| CN | 107420998 | A | | 12/2017 |
| JP | H04-186048 | A | | 7/1992 |
| JP | H05-187697 | A | | 7/1993 |
| JP | H06-257829 | A | | 9/1994 |
| JP | 08200778 | A | * | 8/1996 |
| JP | H08-200778 | A | | 8/1996 |
| JP | 2001-324192 | A | | 11/2001 |
| JP | 2004-340567 | A | | 12/2004 |
| JP | 2007322037 | A | | 12/2007 |
| JP | 2011-133145 | A | | 7/2011 |
| JP | 2014-194309 | A | | 10/2014 |
| WO | 2015/092831 | A1 | | 6/2015 |

OTHER PUBLICATIONS

Office Action dated Sep. 29, 2021, issued in corresponding CN Patent Application No. 201880097053.6 (and English Machine Translation).

Office Action dated Sep. 30, 2021, issued in corresponding AU Patent Application No. 2018441289.

Japanese Office Action dated Jun. 22, 2021 issued in corresponding JP patent application No. 2020-546652 (and English machine translation).

Decision of Rejection dated Jul. 26, 2022 issued in corresponding CN Patent Application No. 201880097053.6 (and English Machine Translation).

International Search Report of the International Searching Authority dated Nov. 27, 2018 for the corresponding International application No. PCT/JP2018/034199 (and English translation).

Office Action dated Jun. 12, 2023 issued in corresponding DE Patent Application No. 11 2018 007 982.1 (and English Machine Translation).

* cited by examiner

AIR-CONDITIONING SYSTEM

This application is a U.S. national stage application of PCT/JP2018/034199 filed on Sep. 14, 2018, the contents of which are incorporated herein by reference.

TECHNICAL FIELD

The present disclosure relates to an air-conditioning system, and in particular, control of a plurality of indoor units.

BACKGROUND ART

In recent years, in common household also, a variable refrigerant flow system referred to as a housing air-conditioner in which an outdoor unit and a plurality of indoor units are connected by pipes to form a refrigerant circuit for conditioning air has been provided. Since a single outdoor unit is provided for a plurality of indoor units, in a ground where a house is located, it is possible to reduce the space required to install the outdoor unit. It is assumed that the plurality of indoor units are installed in respective rooms.

In such a housing air-conditioner as descried above, in general, instructions are sent to the indoor units in the rooms by using remote control units that are present in the respective rooms to remotely operate the indoor units. For example, a signal including an instruction is sent from a remote control unit A in a room A to an indoor unit A installed in the room A. In many housing air-conditioning systems, the remote control unit is a wireless remote control unit that wirelessly performs communication.

In order that a person who is present in a room remotely operate an indoor unit installed in another room, in many cases, a remote-control controlling system in which a dedicated centralized remote control unit is provided is established in addition to a communication system between the outdoor unit and the indoor units (for example, see Patent Literature 1). Furthermore, in order to perform communication using the above remote-control controlling system, and the centralized remote control unit and either the indoor units or the outdoor unit are connected to each other such that and the centralized remote control unit and either the indoor units or the outdoor unit can communicate with each other, and then new communication lines need to be set between the indoor units and the outdoor unit. It should be noted that in many instances, the centralized remote control unit in the remote-control controlling system is connected to the indoor units or the outdoor unit by communication lines.

CITATION LIST

Patent Literature

Patent Literature 1: Japanese Unexamined Patent Application Publication No. 2001-324192

SUMMARY OF PRESENT DISCLOSURE

Technical Problem

In order that an indoor unit in a room be operated by using a remote control unit in another room as in the remote-control controlling system of Patent Literature 1, for example, it is necessary to establish a communication system different from a communication system between indoor units and an outdoor unit, which is commonly used. Furthermore, in order to establish such a communication system, it is necessary to set devices and carry out writing.

The present disclosure is applied to solve the above problems, and relates to an air-conditioning system that enables a person who is present in a room to operate an indoor unit installed in another room, without setting devices and carrying out wiring.

Solution to Problem

To solve the above problems, an air-conditioning system of an embodiment of the present disclosure includes: an outdoor unit including an outdoor-side control device; a plurality of indoor units each including an indoor-side control device configured to control a device included in each indoor unit, in response to an instruction; a plurality of communication lines that each connect the outdoor unit and an associated one of the plurality of indoor units to enable the outdoor unit and the associated indoor unit to communicate with each other; and a remote control unit that includes a remote-control controlling device and is configured to wirelessly communicate with each of the indoor units. Each of the indoor units includes an indoor-side setting device configured to determine an identification number that identifies the indoor unit. When receiving a signal including the instruction that is sent from the remote control unit, the indoor-side control device determines whether or not to control the device based on a set identification signal, and sends the signal including the instruction to the outdoor unit via an associated one of the communication lines. The outdoor-side control device determines which of the indoor units is an instruction target that is an indoor unit to be given an instruction, based on the identification signal included in the signal that is sent via the associated communication line, and sends the signal including the instruction to the indoor unit that is the instruction target, via an associated one of the communication lines.

Advantageous Effects of Present Disclosure

In the air-conditioning system according to an embodiment of the present disclosure, identification numbers are assigned to respective indoor units. In addition, an instruction signal to be sent includes the identification number of an indoor unit that is to be given an instruction, as an instruction target. Then, based on the identification number included in in the sent signal, the signal including the instruction can be sent from one of the indoor units to another one of the indoor units that is identified by the identification number, via the communication lines and the outdoor unit.

DESCRIPTION OF EMBODIMENTS

An air-conditioning system according to an embodiment of the present disclosure will be described with reference to the drawings. In each of the above figures, components that are the same as or equivalent to those in a previous figure are denoted by the same reference signs, and the same is true of the entire text of the embodiments as described below. Also, in each of the figures, the relationship in size between components may be different from an actual one. The configurations of components are described by way of example in the entire specification, and are not limited to those described in the specification. In particular, in the case where components are combined, it is not limited to the case where components according to the same embodiment are combined. A component in an embodiment can be applied to another embodiment as appropriate. Also, the levels of temperature, pressure, etc., are not determined in relation to absolute values, that is, they are relatively determined depending on the state and operation of the system or apparatus, for example. In addition, with respect to a plurality of devices that are of the same type and distinguished from each other by suffixes, in the case where they do not particularly need to be identified or distinguished from each other, the suffixes may be omitted.

Embodiment 1

Figure 1:
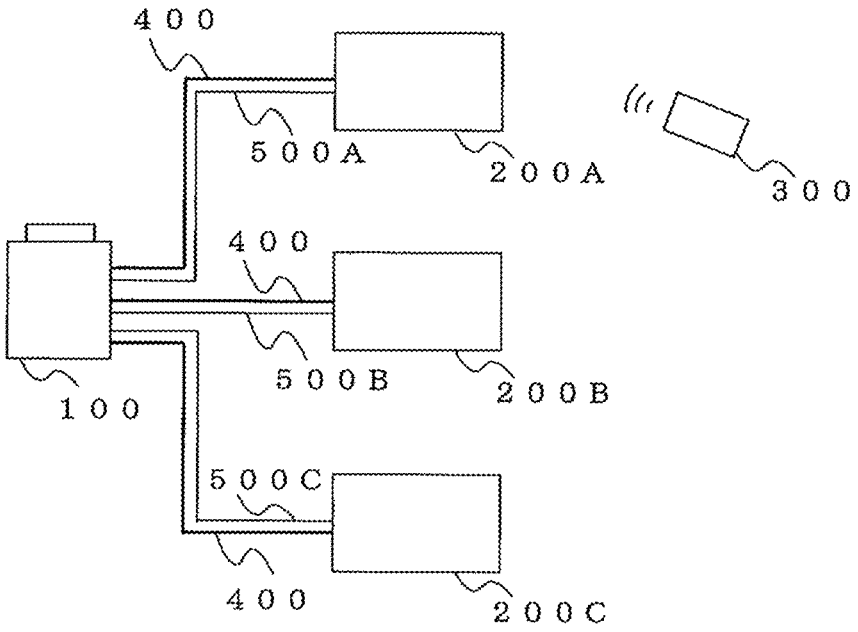
FIG. 1 is a diagram illustrating a configuration of an air-conditioning system according to Embodiment 1 of the present disclosure.

FIG. 1 is a diagram illustrating a configuration of an air-conditioning system according to Embodiment 1 of the present disclosure. In particular, it will be described by referring mainly to configurations related to the communication and control system of the air-conditioning system. The air-conditioning system as described below is an example, and the air-conditioning system according to the present disclosure is not limited to the system as illustrated in FIG. 1.

The air-conditioning system according to Embodiment 1 is a so-called housing air-conditioner in which a plurality of indoor units 200 and an outdoor unit 100 are connected by pipes 400 to form a refrigerant circuit and perform air-conditioning in a house. To be more specific, as illustrated in FIG. 1, in the air-conditioning system according to Embodiment 1, a single outdoor unit 100 and three indoor units 200A, 200B, and 200C are connected by the pipes 400. It is assumed that pipes between the indoor units 200 and the outdoor unit 100 are arranged independently of each other. The indoor units 200 are installed at respective locations in the house. In the air-conditioning system of Embodiment 1, it is assumed that the indoor units 200A to 200C are installed in respective rooms.

As illustrated in FIG. 1, in the air-conditioning system of Embodiment 1, the indoor units 200 are connected to the outdoor unit 100 by respective communication lines 500. Thus, the indoor units 200 and the outdoor unit 100 can communicate with each other using signals including various data. To be more specific, the outdoor unit 100 and the indoor unit 200A are connected to each other by a communication line 500A to communicate with each other; likewise, the outdoor unit 100 and the indoor unit 200B are connected to each other by a communication line 500B to communicate with each other; and likewise, the outdoor unit 100 and the indoor unit 200C are connected to each other by a communication line 500C to communicate with each other. In addition, a remote control unit 300 is provided, and can wirelessly communicate with each of the indoor units 200.

Figure 2:
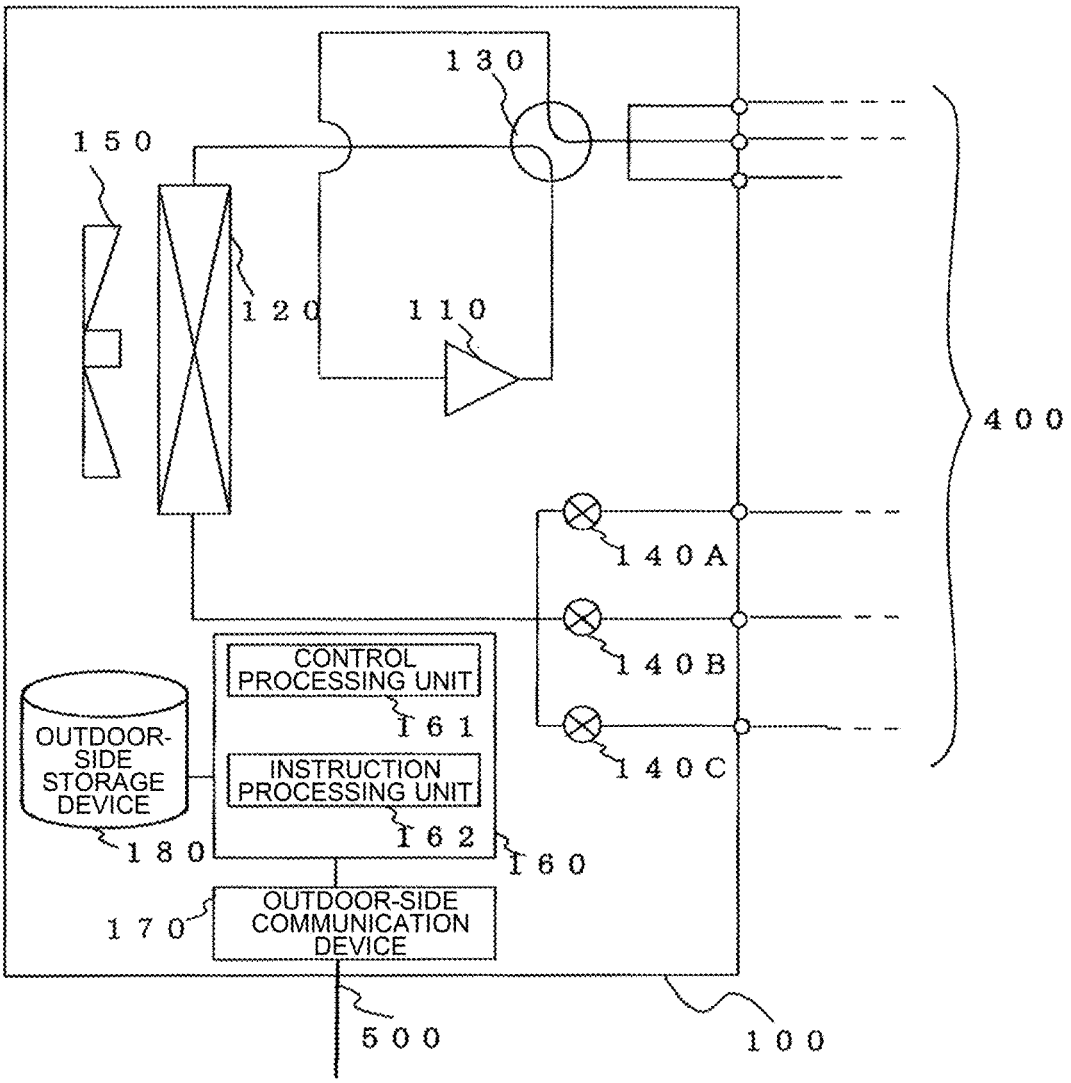
FIG. 2 is a diagram illustrating a configuration of an outdoor unit 100 according to Embodiment 1 of the present disclosure.

FIG. 2 is a diagram illustrating a configuration of the outdoor unit 100 according to Embodiment 1 of the present disclosure. The outdoor unit 100 includes, as devices of an operation system related to air-conditioning, a compressor 110, an outdoor-side heat exchanger 120, a switching device 130, expansion devices 140, and an outdoor-side fan 150. Furthermore, the outdoor unit 100 includes, as devices of communication and control systems, an outdoor-side control device 160, an outdoor-side communication device 170, and an outdoor-side storage device 180. It is assumed that the outdoor-side control device 160, the outdoor-side communication device 170, and the outdoor-side storage device 180 are separate devices, but for example, these devices may be provided as a single controller that is set on a substrate.

The compressor 110 compresses sucked refrigerant and discharges the compressed refrigerant using a pressure based on a driving frequency. In addition, the outdoor-side heat exchanger 120 causes heat exchange to be performed between outdoor air and refrigerant that passes through the heat exchanger. The outdoor-side fan 150 sends outdoor air to the outdoor-side heat exchanger 120. The switching device 130 is, for example, a four-way valve that switches a refrigerant flow passage for the refrigerant between a refrigerant flow passage for a heating operation and that for a cooling operation. The expansion devices 140 are provided in association with the respective indoor units 200. To be more specific, as illustrated in FIG. 2, the outdoor unit 100 according to Embodiment 1 includes three expansion devices 140A, 140B, and 140C that are provided in association with the respective indoor units 200. The expansion devices 140 each include a valve, and adjusts an opening degree of the valve in response to an instruction from the outdoor-side control device 160 to adjust the flow rate and pressure of refrigerant that is sent to an associated one of the indoor units 200.

The outdoor-side control device 160 of Embodiment 1 controls devices included in the outdoor unit 100, and perform other operations. In particular, the outdoor-side control device 160 performs processing related to transmission and reception of signals concerning instructions that are performed between the respective indoor units 200. The outdoor-side control device 160 includes a control processing unit 161 and an instruction processing unit 162. The control processing unit 161 performs processing to control operations of the devices included in the outdoor unit 100 based on a signal that is sent from a detection device (not illustrated) installed in the outdoor unit 100, signals that are sent from the indoor units 200, and other signals. The instruction processing unit 162 performs processing to process signals that are sent from the indoor units 200, and send, when determining that the signal sent from one of the indoor units 200 is a signal including an instruction to another one of the indoor units 200, the instruction to the above other one of the indoor units 200.

The outdoor-side communication device 170 is connected to the communication lines 500, and serves as an interface for signal communications between the communication lines 500 and the outdoor-side control device 160 to transmit and receive various kinds of signals. In addition, the outdoor-side storage device 180 stores, temporarily or for a long time period, data that is necessary for the outdoor-side control device 160 to perform processing. In particular, the outdoor-side storage device 180 stores data indicating identification numbers assigned to the respective indoor units 200.

The outdoor-side control device 160 is, for example, a device that performs a control calculation processing, such as a computer that uses a central processing unit (CPU) as a main component. The outdoor-side control device 160 executes a program that is previously made for a procedure of processing of each of units to execute the processing of each unit. For example, the outdoor-side storage device 180 stores data on the program. However, the execution of the processing is not limited only to the execution of the program. Each of the units may be formed as a dedicated device that executes associated processing. In addition, the outdoor-side storage device 180 includes a volatile storage device (not illustrated) such as a random access memory (RAM) that can temporarily store data, and a non-volatile auxiliary storage device (not illustrated) such as a hard disc or a flash memory that can store data for a long time.

Figure 3:
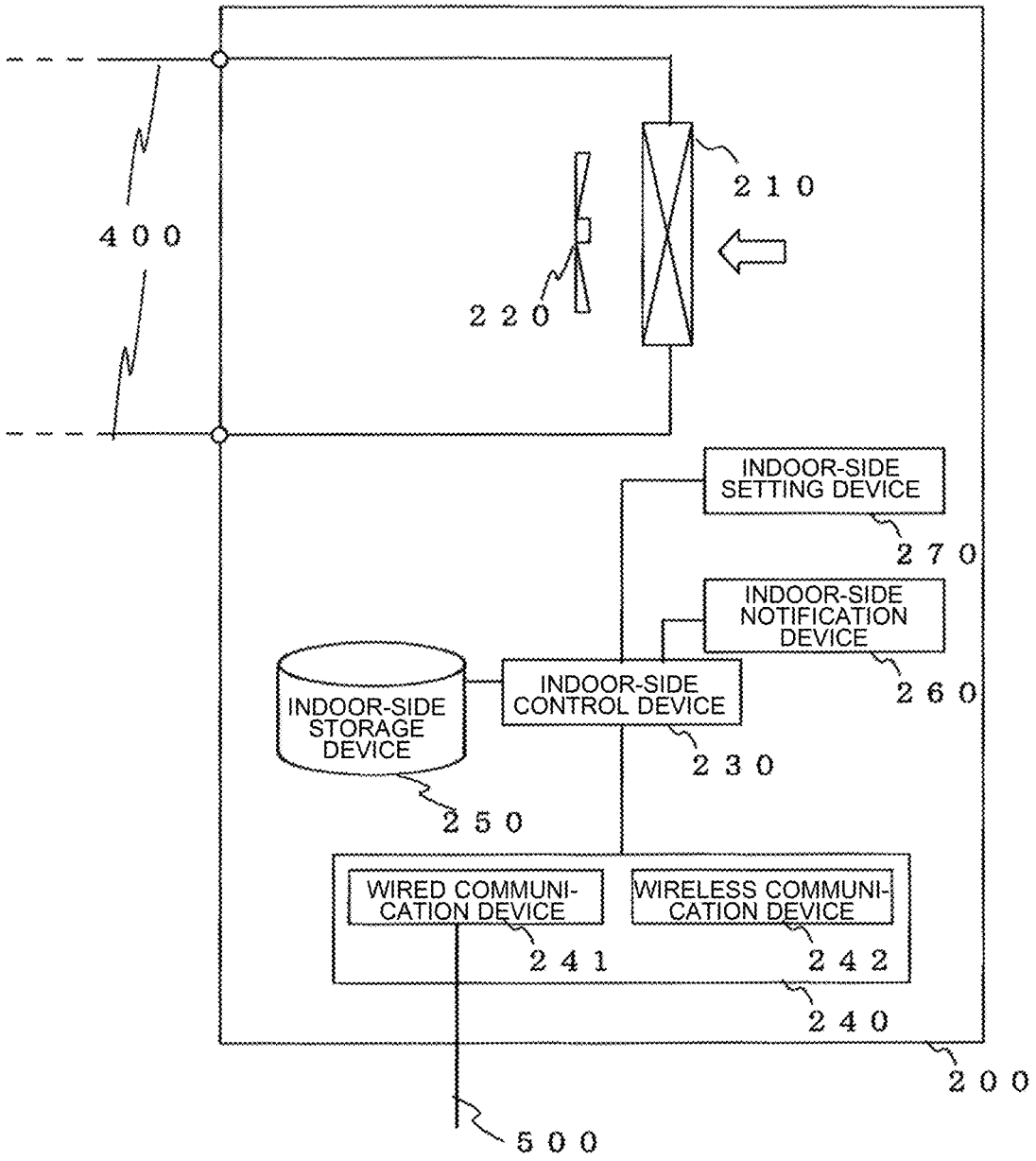
FIG. 3 is a diagram illustrating a configuration of an indoor unit 200 according to Embodiment 1 of the present disclosure.

FIG. 3 is a diagram illustrating a configuration of each of the indoor units 200 according to Embodiment 1 of the present disclosure. The indoor unit 200 includes, as devices of the operation system related to air-conditioning, an indoor-side heat exchanger 210 and an indoor-side fan 220. In addition, the indoor unit 200 includes, as devices of the communication and control systems, an indoor-side control device 230, an indoor-side communication device 240, an indoor-side storage device 250, an indoor-side notification device 260, and an indoor-side setting device 270. It is assumed that the indoor-side control device 230, the indoor-side communication device 240, the indoor-side storage device 250, the indoor-side notification device 260, and the indoor-side setting device 270 are separate devices. However, for example, these devices may be formed as a single controller.

The indoor-side heat exchanger 210 causes heat exchange to be performed between refrigerant that passes through the heat exchanger and indoor air in an associated room. The indoor-side fan 220 sends the indoor air such that the indoor air passes through the indoor-side heat exchanger 210, and then re-flows into the room.

The indoor-side control device 230 controls, for example, the devices included in the indoor unit 200. In addition, the indoor unit 200 performs processing related to the operation of the indoor unit 200 in response to an instruction included in a signal sent from the outdoor unit 100 via the associated communication line 500, in addition to an instruction included in a signal sent from the remote control unit 300. It should be noted that the indoor-side control device 230 of Embodiment 1 makes a determination based on the sent signal. When determining that the instruction is not an instruction to an indoor unit 200 in which the indoor-side control device itself is provided, the indoor-side control device 230 sends the signal including the instruction to the outdoor unit 100 and does not control the devices based on the instruction.

The indoor-side communication device 240 includes a wired communication device 241 and a wireless communication device 242. The wired communication device 241 is connected to each of the communication lines 500, and serves as an interface for signal communications between the communication line 500 and the indoor-side control device 230 to transmit and receive various kinds of signals to and from the outdoor-side control device 160. The wireless communication device 242 serves as an interface for signal communications between the indoor-side control device 230 and the remote control unit 300 to transmit and receive various kinds of signals to and from the remote control unit 300.

In addition, the indoor-side storage device 250, as well as the outdoor-side storage device 180, includes a volatile storage device (not illustrated) and a non-volatile auxiliary storage device (not illustrated). The indoor-side control device 230 stores, temporarily or for a long time, data that is necessary for the indoor-side control device 230 to perform processing. The indoor-side storage device 250 of Embodiment 1 stores data, especially data indicating set identification numbers.

The indoor-side notification device 260 makes in the room, a notification indicating that an operation has been performed, based on a notification signal sent from the indoor-side control device 230. The contents of the notification and the way of making the notification are not particularly limited. The indoor-side notification device 260 can make a visual notification such as a display using, for example, an image or characters, and a light-emitting display, a notification using voice or buzz, and other kinds of notifications. In addition, the indoor-side setting device 270 is a device that is set to determine an identification number of the indoor unit 200. Although it is not particularly limited, the indoor-side setting device 270 is set by jumper pins or a DIP switch, for example. It is assumed that in the air-conditioning system of Embodiment 1, the above setting is performed such that the identification number "1" is assigned to the indoor unit 200A; the identification number "2" is assigned to the indoor unit 200B; and the identification number "3" is assigned to the indoor unit 200C.

Figure 4:
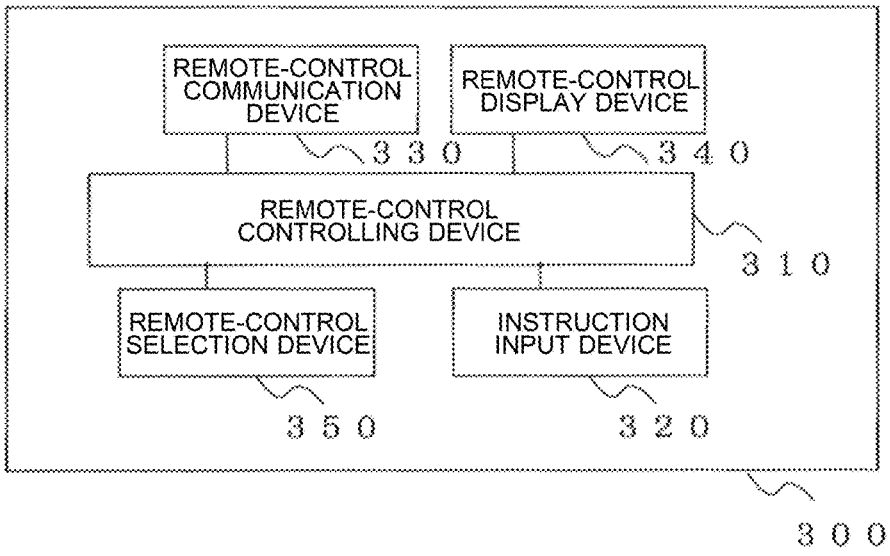
FIG. 4 is a diagram illustrating a configuration of a remote control unit 300 according to Embodiment 1 of the present disclosure.

FIG. 4 is a diagram illustrating a configuration of the remote control unit 300 according to Embodiment 1 of the present disclosure. The remote control unit 300 of Embodiment 1 includes a remote-control controlling device 310, an instruction input device 320, a remote-control communication device 330, a remote-control display device 340, and a remote-control selection device 350. The instruction input device 320 includes buttons and other components. To the instruction input device 320, for example, an instruction to start or stop an operation, or an instruction regarding a temperature or an air volume is input. The input instruction is sent to the remote-control controlling device 310. The remote-control communication device 330 transmits a signal associated with the instruction sent from the remote-control controlling device 310. The remote-control communication device 330 of Embodiment 1 transmits the signal using infrared light; however, this is not limiting.

The remote-control display device 340 displays a set temperature or an air volume setting or other settings based on a display signal sent from the remote-control controlling device 310. The remote-control selection device 350 is a device that selects and sets an indoor unit 200 as an instruction target that is to be given an instruction. The remote-control selection device 350 of Embodiment 1 includes a selector switch. A user operates the selector switch to select and set any of the indoor units 200 as the instruction target. The selector switch enables the user to easily select and set an indoor unit.

Then, the remote-control controlling device 310 controls the entire remote control unit 300. In particular, in Embodiment 1, an identification number selected by the remote-control selection device 350 is added to an instruction input at the instruction input device 320, and the instruction is then sent to the remote-control communication device 330. Embodiment 1 will be described on the assumption that the remote control unit 300 includes the remote-control controlling device 310. However, it is not limiting. The instruction input device 320, the remote-control communication device 330, the remote-control display device 340, and the remote-control selection device 350 may also share the functions that are fulfilled by the remote-control controlling device 310.

In an air-conditioning system that is typified by a housing air-conditioner, for example, in the past, an instruction given from a remote control unit has been used for an indoor-side control device of an indoor unit that has received the instruction to perform processing and an operation based on the instruction determined as an instruction to the indoor unit in which the indoor-side control device itself is provided, and perform the operation. In the air-conditioning system according to Embodiment 1, data indicating the identification number of an indoor unit 200 that is an instruction target is added to a signal regarding an instruction sent from the remote control unit 300. Then, an indoor unit 200 that has received the signal sends the signal to the outdoor unit 100 via the communication line 500. The outdoor unit 100 sends the signal to the indoor unit 200 that is the instruction target, via the communication line 500. The indoor unit 200 performs processing and operates based on the received instruction. Since the data indicating the identification number of the indoor unit 200 is added to the signal regarding the instruction, the instruction from the remote control unit 300 can be sent to the indoor unit 200 that is the instruction target, via the indoor unit 200 and the outdoor unit 100 that both have received the signal.

Figure 5:
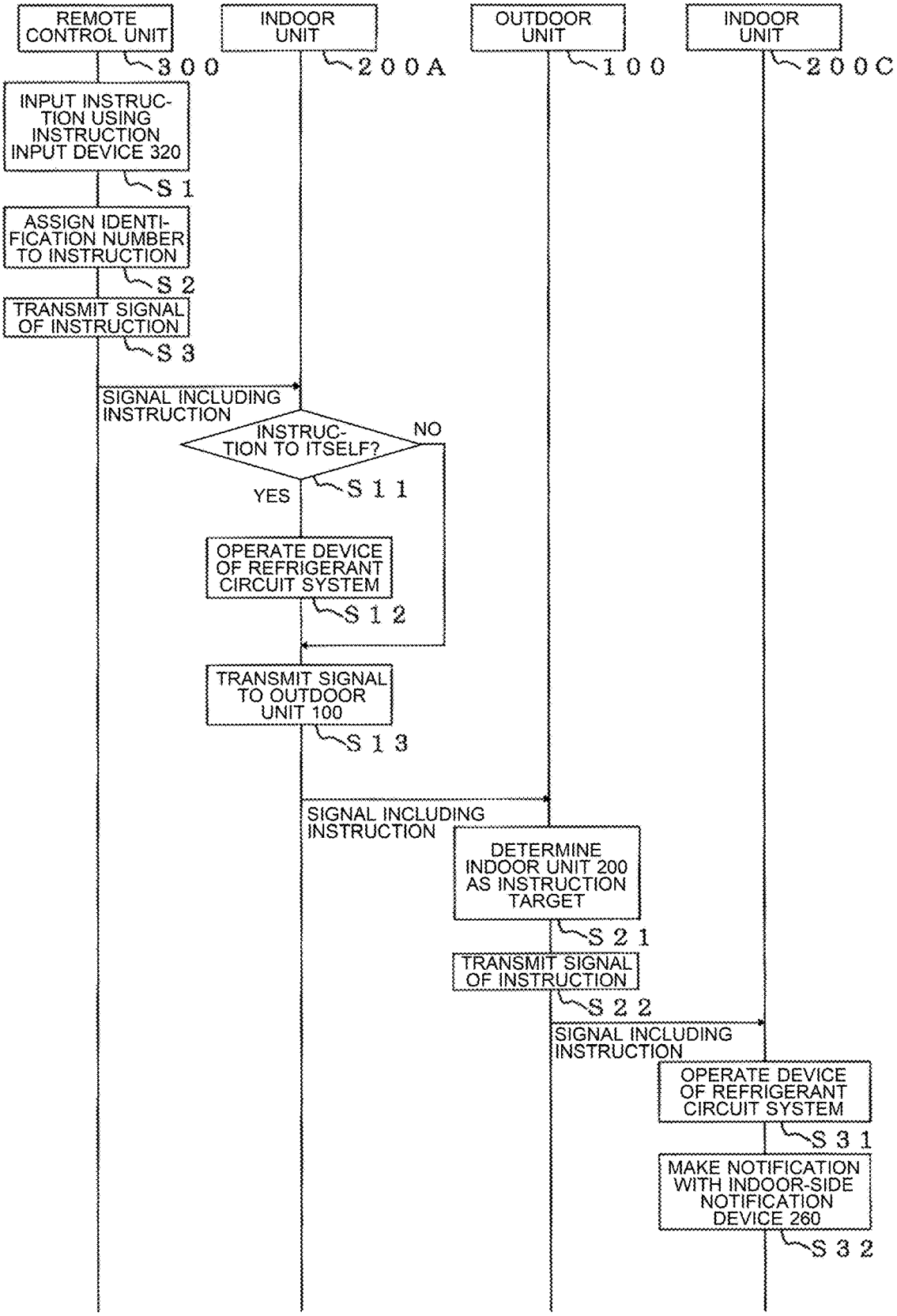
FIG. 5 is a diagram illustrating the flow of processing of the air-conditioning system according to Embodiment 1 of the present disclosure.

FIG. 5 is a diagram illustrating the flow of processing of the air-conditioning system according to Embodiment 1 of the present disclosure. The processing will be described by referring to by way of example the case where the user gives an instruction to the indoor unit 200C via the indoor unit 200A as a remote control operation, using the remote control unit 300. The user selects and sets the identification number that is assigned to the indoor unit 200C, using the remote-control selection device 350, and inputs an instruction using the instruction input device 320 (step S1). The remote-control controlling device 310 adds the identification number to the input instruction, and sends the instruction to the remote-control communication device 330 (step S2). The remote-control communication device 330 sends a signal including the instruction to the indoor unit 200A (step S3).

Processing at the indoor unit 200A is executed by an indoor-side control device 230A. When receiving the signal from the remote control unit 300 via the wireless communication device 242, the indoor-side control device 230A determines whether or not the instruction is an instruction to an indoor unit 200 in which the indoor-side control device 230A itself is provided, based on the identification number in the signal (step S11). When determining that the instruction is an instruction to the indoor unit 200 in which the indoor-side control device 230A itself is provided, the indoor-side control device 230A causes devices of a refrigerant circuit system to operate in response to the instruction (step S12). Furthermore, the indoor-side control device 230A sends the received signal to the outdoor unit 100 via the wired communication device 241 (step S13). In addition, for example, with regard to a wind speed, a wind direction, and other setting items, the indoor-side control device 230A controls the devices of the refrigerant circuit system in the indoor unit 200 to cause the devices to operate. It should be noted that data on the wind speed, the wind direction, or other setting items of each of the indoor units 200 is used at the outdoor unit 100 as data for use in control of the refrigerant circuit. Therefore, the indoor-side control device 230A also sends the signal to the outdoor unit 100, though the instruction is an instruction to the devices that controls the operation.

By contrast, in step S11, when determining that the instruction is an instruction to another indoor unit 200, the indoor-side control device 230A sends the received signal to the outdoor unit 100 via the wired communication device 241 (step S13). Since the air-conditioning system of Embodiment 1 is the housing air-conditioner, in many cases, the communication lines 500 are not directly connected between the indoor units 200. Therefore, in the air-conditioning system, the instruction is sent to the indoor unit 200 that is the instruction target, via the outdoor unit 100.

Processing at the outdoor unit 100 is executed by the outdoor-side control device 160, and primarily by the instruction processing unit 162. When receiving the signal from the indoor unit 200 via the outdoor-side communication device 170, the outdoor-side control device 160 determines which of the indoor units 200 is the instruction target based on an identification signal included in the signal (step S21). Then, the outdoor-side control device 160 sends the signal related to the instruction to the indoor unit 200 determined as the instruction target, via the outdoor-side communication device 170 and the communication line 500 (step S22). It should be noted that when determining that the indoor unit 200 determined as the instruction target is the indoor unit 200A that has sent the signal, the outdoor-side control device 160 does not send the signal.

An indoor-side control device 230C in the indoor unit 200C, which is the indoor unit 200 determined as the instruction target, controls devices based on the instruction sent via the communication line 500 and the wired communication device 241 (step S31). At this time, the indoor-side control device 230C transmits a notification signal to the indoor-side notification device 260 to cause the indoor-side notification device 260 to make a notification that the operation is to be performed (step S32).

As described above, according to the air-conditioning system of Embodiment 1, the remote control unit 300 includes the remote-control selection device 350, and can select and set an indoor unit 200 as the instruction target. Then, the data on the identification number of the indoor unit 200 that is the instruction target is added to the signal including the instruction, and communication between the remote control unit 300, the indoor unit 200, and the outdoor unit 100 can be performed via the communication lines 500. Thus, without adding new hardware such as a communication device such as a centralized remote control unit, and wiring, for example, a signal including an instruction from one of the indoor units 200 can be sent, and the instruction can be given to the indoor unit 200 that is the instruction target. For example, an instruction that is issued in a certain room via the remote control unit 300 as an instruction regarding an operation of an indoor unit 200 installed in another room can be given via the indoor unit 200 installed in the certain room, the outdoor unit 100, and the communication line 500.

For example, in the case where the number of the indoor units 200 is two, even in the case where identification numbers are not assigned to the indoor units 200, it suffices that each of the indoor units 200 determines whether the instruction is an instruction to the indoor unit 200 itself or not. Thus, it is possible to easily determine which of the indoor units 200 is the instruction target. Therefore, the system of Embodiment 1 is particularly effective for an air-conditioning system including three or more indoor units.

Embodiment 2

Figure 6:
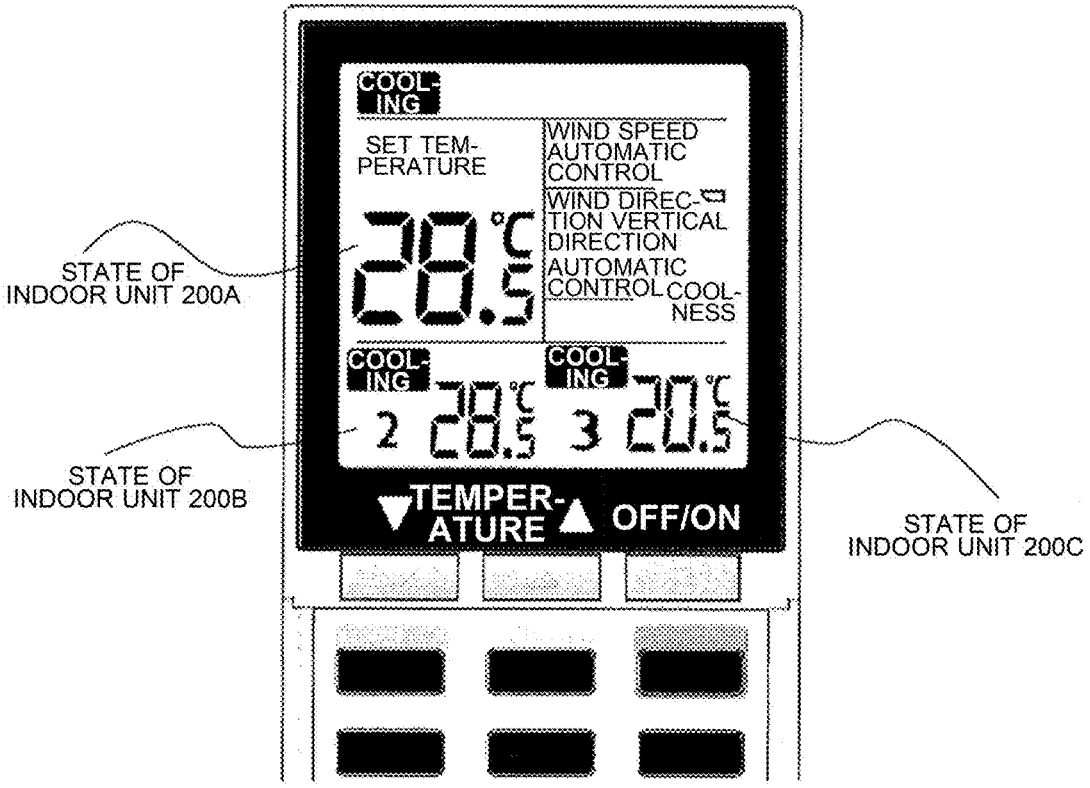
FIG. 6 is a diagram illustrating a display screen at the remote control unit 300 according to Embodiment 2 of the present disclosure.

FIG. 6 is a diagram illustrating a display screen at a remote control unit 300 according to Embodiment 2 of the present disclosure. In air-conditioning system according to Embodiment 2, in the case where the remote control unit 300 can receive a signal from an indoor unit 200, a remote-control display device 340 of the remote control unit 300 displays a state of another indoor unit 200 or states of other indoor units 200. The air-conditioning system of Embodiment 2 will be described on the assumption that it has the same configuration as the system as illustrated in FIG. 1 that is described above with respect to Embodiment 1.

On the display screen as illustrated in FIG. 6, it is indicated whether each of three indoor units 200 is in cooling operation or heating operation, and set temperatures set at the indoor units 200 are indicated. Furthermore, as illustrated in FIG. 6, on the display screen, a display area for an indoor unit 200A having the identification number "1 " is the largest, and indicates not only whether the indoor unit 200A is in cooling operation or heating operation and the set temperature for the indoor unit 200A, but also the wind direction, the wind speed, and other setting items. Basically, a larger area of the display screen of the remote control unit displays the state of an indoor unit 200 with which the remote control unit directly communicates and which is located in the same room as the remote control unit, but may display the state of another indoor unit by changing, using the instruction input device 320, the indoor unit to be displayed on the larger area of the display screen to the above other indoor unit.

As described above, according to the air-conditioning system according to Embodiment 2, bidirectional communication can be performed between each of the indoor units 200 and the remote control unit 300. Thus, an indoor unit 200 can transmit a signal including data on the state of the other indoor unit or units 200 to the remote control unit 300, and the state can be displayed on the remote-control display device 340 of the remote control unit 300. Therefore, the user can easily know a state of a room in which the other indoor unit 200 is installed, and make an instruction by operating the remote control unit 300.

Embodiment 3

With respect to Embodiment 1, it is described above that the remote-control selection device 350 of the remote control unit 300 includes the selector switch, but it is not limiting. For example, the remote-control controlling device 310 may also serve as the remote-control selection device 350. Then, the remote-control controlling device 310 may also perform processing to select and set an indoor unit 200 as the instruction target based on an instruction that is input by the user to the instruction input device 320, and processing to store information indicating which of the indoor units 200 is the instruction target, in the storage device included in the remote-control controlling device 310.

REFERENCE SIGNS LIST

100 outdoor unit 110 compressor 120 outdoor-side heat exchanger
130 switching device 140, 140A, 140B, 140C expansion device 150 outdoor-side fan 160 outdoor-side control device 161 control processing unit
162 instruction processing unit 170 outdoor-side communication device
180 outdoor-side storage device 200, 200A, 200B, 200C indoor unit 210 indoor-side heat exchanger 220 indoor-side fan 230 indoor-side control device 230A, 230C indoor-side control device 240 indoor-side communication device 241 wired communication device 242 wireless communication device 250 indoor-side storage device 260 indoor-side notification device 270 indoor-side setting device 300 remote control unit
310 remote-control controlling device 320 instruction input device 330 remote-control communication device 340 remote-control display device
350 remote-control selection device 500, 500A, 500B, 500C communication line

The invention claimed is:

1. An air-conditioning system comprising:
an outdoor unit including an outdoor-side control device;
a plurality of indoor units each including an indoor-side control device configured to control devices included in each indoor unit, in response to an instruction;
a plurality of communication lines that each connect the outdoor unit and an associated one of the plurality of indoor units to enable the outdoor unit and the associated indoor unit to communicate with each other; and
a remote control unit that includes a remote-control controlling device and is configured to wirelessly communicate with each of the indoor units, wherein
each of the indoor units includes an indoor-side setting device configured to determine an identification number that identifies the indoor unit,
when receiving a signal including the instruction that is sent from the remote control unit, the indoor-side control device
determines whether or not to control the devices in the indoor unit based on a set identification signal, and
sends the signal including the instruction to the outdoor unit, regardless of the determination of whether or not to control the devices in the indoor unit, via an associated one of the communication lines, and
the outdoor-side control device
determines which of the indoor units is an instruction target that is an indoor unit to be given an instruction, based on the identification signal included in the signal that is sent via the associated communication line, and
sends the signal including the instruction to the indoor unit that is the instruction target, via an associated one of the communication lines.

2. The air-conditioning system of claim 1, wherein
each of the indoor units includes a notification device configured to make a notification based on a notification signal, and
when receiving the signal including the instruction from the outdoor unit via the associated communication line, the indoor-side control device sends the notification signal to cause the notification device to make the notification.

3. The air-conditioning system of claim 2, wherein
the remote control unit includes a remote-control selection device configured to select and set one of the indoor units as the instruction target, and
the signal including the instruction that is sent from the remote control unit includes data indicating the identification number of the indoor unit selected and set by the remote-control selection device.

4. The air-conditioning system of claim 3, wherein
the remote-control selection device is a selector switch.

5. The air-conditioning system of claim 2, wherein
the remote control unit includes a remote-control display device, and
the remote-control controlling device causes the remote-control display device to display states of the plurality of indoor units based on signals sent from the indoor units.

6. The air-conditioning system of claim 2, wherein
the number of the indoor units is three or more, and
the three or more indoor units are connected to the outdoor unit by the communication lines such that each of the indoor units and the outdoor unit are capable of communicating with each other.

7. The air-conditioning system of claim 1, wherein
the remote control unit includes a remote-control selection device configured to select and set one of the indoor units as the instruction target, and
the signal including the instruction that is sent from the remote control unit includes data indicating the identification number of the indoor unit selected and set by the remote-control selection device.

8. The air-conditioning system of claim 7, wherein
the remote-control selection device is a selector switch.

9. The air-conditioning system of claim 8, wherein
the remote control unit includes a remote-control display device, and
the remote-control controlling device causes the remote-control display device to display states of the plurality of indoor units based on signals sent from the indoor units.

10. The air-conditioning system of claim 8, wherein
the number of the indoor units is three or more, and
the three or more indoor units are connected to the outdoor unit by the communication lines such that each of the indoor units and the outdoor unit are capable of communicating with each other.

11. The air-conditioning system of claim 7, wherein
the remote control unit includes a remote-control display device, and
the remote-control controlling device causes the remote-control display device to display states of the plurality of indoor units based on signals sent from the indoor units.

12. The air-conditioning system of claim 7, wherein
the number of the indoor units is three or more, and
the three or more indoor units are connected to the outdoor unit by the communication lines such that each of the indoor units and the outdoor unit are capable of communicating with each other.

13. The air-conditioning system of claim 1, wherein
the remote control unit includes a remote-control display device, and
the remote-control controlling device causes the remote-control display device to display states of the plurality of indoor units based on signals sent from the indoor units.

14. The air-conditioning system of claim 13, wherein
the number of the indoor units is three or more, and
the three or more indoor units are connected to the outdoor unit by the communication lines such that each of the indoor units and the outdoor unit are capable of communicating with each other.

15. The air-conditioning system of claim 1, wherein
the number of the indoor units is three or more, and
the three or more indoor units are connected to the outdoor unit by the communication lines such that each of the indoor units and the outdoor unit are capable of communicating with each other.

* * * * *